United States Patent [19]

Yamazaki

[11] 4,047,325

[45] Sept. 13, 1977

[54] BATON TWIRLING FIGURE

[75] Inventor: Tomio Yamazaki, Tokyo, Japan

[73] Assignee: Tomy Kogyo Co., Inc., Tokyo, Japan

[21] Appl. No.: 715,242

[22] Filed: June 18, 1976

[30] Foreign Application Priority Data

Aug. 27, 1975 Japan ..... 50-118589[U]

[51] Int. Cl.[2] ..... A63H 11/10

[52] U.S. Cl. ..... 46/106; 46/107

[58] Field of Search ..... 46/106, 107, 109, 116, 46/269

[56] References Cited

U.S. PATENT DOCUMENTS

| | | | |
|---|---|---|---|
| 2,437,442 | 3/1948 | Siwiec | 46/107 |
| 2,706,601 | 5/1955 | Goerditz | 46/107 |
| 2,934,854 | 5/1960 | Comfort | 46/107 |
| 3,066,442 | 12/1962 | Aye | 46/107 |
| 3,100,949 | 8/1963 | Brenneman | 46/116 |

*Primary Examiner*—Louis G. Mancene
*Assistant Examiner*—Robert F. Cutting
*Attorney, Agent, or Firm*—Edward D. O'Brian

[57] ABSTRACT

A baton twirling doll having a torso, arms, legs, and a head which are all connected so as to simulate the human body can be connected to a support structure used to provide power to move one or more parts of the body with respect to other parts of the body. The support structure used includes a wheeled platform and a support member extending from the platform to the torso of the doll. A mechanical drive is connected to the wheels of the platform so as to be operated when the platform is rolled along a surface. This drive is connected with a motion transmitting structure within the torso of the doll for moving at least one part of the doll relative to the remainder of the doll. Preferably the doll is constructed so that a hand on one of the arms of the doll is rotated as the arm holding this hand is rotated and so that the legs of the doll are moved to simulate normal leg movement as the wheeled platform is moved along a surface. With such a structure a baton may be held by the movable hand so that it will rotate to simulate normal baton movement as the platform is moved.

8 Claims, 11 Drawing Figures

BATON TWIRLING FIGURE

BACKGROUND OF THE INVENTION

The invention set forth in this specification pertains to new and improved dolls. More specifically it pertains to dolls formed so as to simulate the human body which effectively simulate an individual walking and twirling a baton.

It will, of course, be recognized that a wide variety of different types of dolls have been proposed, manufactured and used. It is considered that it would be extremely impractical to even begin to discuss all of the types of known dolls in this specification. In spite of the extreme numbers of different types of dolls which are known it is considered that there is still need for certain types of dolls which can be effectively utilized in what may be loosely referred to as "active" type play—i.e., play by a child of a type requiring the child to physically move as opposed to play by a child merely manipulating and/or paying attention to a doll. Such active play is considered desirable in maintaining a child's attention and in enabling the child to satisfy an apparent need for physical movement.

It is also considered that there is a need for dolls which differ from common dolls in that they effectively simulate the glamour and excitement of a parade to at least a sufficient extent so that a child can mentally associate the doll with a parade in play activities. In effect, this involves a recognition that many existing dolls are essentially of a "passive" type character. It is considered that the attention of a child during play with a doll can be increased by forming the doll of a character such that the child will associate the doll with something such as a parade having a certain degree of glamour and excitement.

BRIEF SUMMARY OF THE INVENTION

The invention set forth in this specification is intended to provide new and improved dolls. More specifically an objective of the invention is to provide dolls which meet the needs which are believed to exist as briefly discussed or indicated in the preceding. Thus, the invention is intended to provide dolls which can be utilized in somewhat active type play activities. The invention is further intended to provide dolls which suggest and/or simulate the glamour and excitement of a parade to a sufficient extent so that a child's imagination will associate play with the doll with a real parade.

Any doll which can be utilized in active play and which will simulate a parade activity or action must, of course, have other characteristics and features to be acceptable. Any such doll must be relatively inexpensive, must be capable of withstanding significant physical abuse, must be capable of being easily used and/or actuated during play, and must be capable of prolonged, reliable performance. Further objectives of this invention are to provide dolls having these characteristics.

The various objectives of this invention are achieved by providing the combination of a doll having a torso, arms, legs and a head connected together so as to simulate the human body and a support structure for holding the doll in which the improvement comprises: the support structure including a wheeled platform, a support member extending from the platform to the torso, mechanical drive means for deriving power from at least one wheel of the platform as the platform is rolled along a surface and for conveying such motion into the interior of the torso and motion transmitting means located within the torso of the doll for moving at least one part of the doll relative to the remainder of the doll as the platform is rolled along a surface.

In accordance with this invention such a doll is preferably constructed so as to simulate a baton twirling figure such as a man or woman serving as drum major or majorette. Such an individual is always the center of attention at a parade and is normally associated mentally with much of the glamour and excitement of a parade. In order to simulate such a drum major or majorette the doll is preferably constructed so that a hand on one of the arms of the doll is rotated as the arm holding this hand in rotated and so that the legs of the doll are moved to simulate the leg movement of a drum major or majorette. A baton may be held by the movable hand.

BRIEF DESCRIPTION OF THE DRAWING

Because of the nature of this invention it is considered that it is best more fully described in reference to the accompanying drawings in which.

Figure 1:
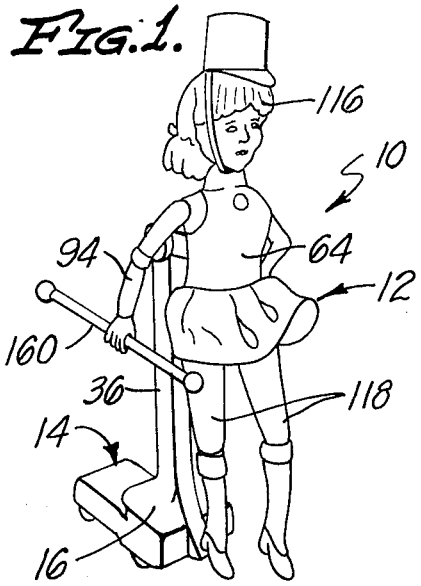
FIG. 1 is a front perspective view of a presently preferred embodiment of a baton twirling doll in accordance with the invention.
Figure 4:
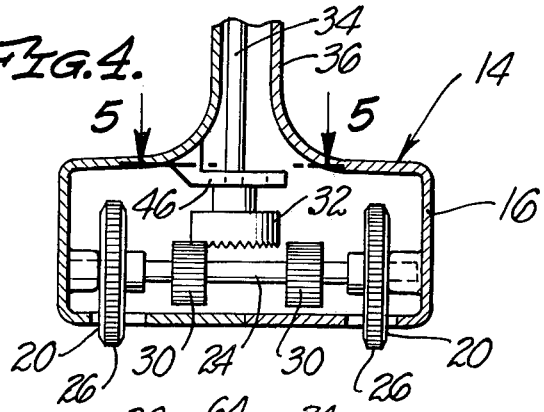
FIG. 4 is a partial cross-sectional view taken at line 4—4 of FIG. 3.
Figure 3:
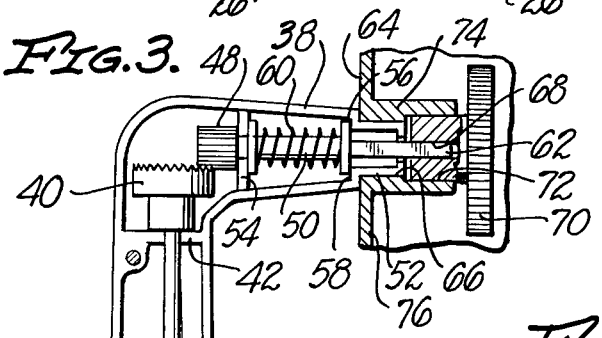
FIG. 3 is a side elevational view, partially in section, at an enlarged scale indicating the wheeled platform and support member employed with the doll and indicating the connection of the mechanical drive means within the platform and the support member with a part of the motion transmitting means located within the torso of the doll.
Figure 2:
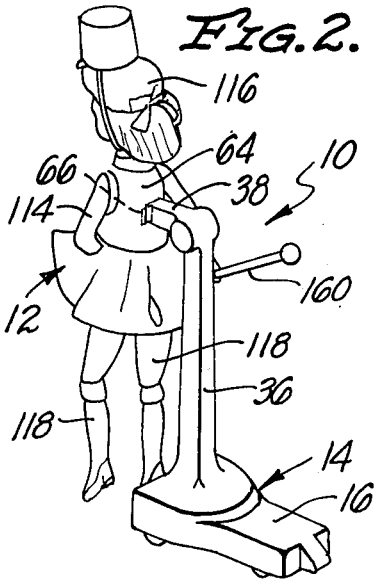
FIG. 2 is a rear perspective view of the doll shown in FIG. 1.

The particular doll illustrated in the drawings is constructed so as to utilize the operative concepts or principles set forth in the appended claims. These concepts or principles may be easily utilized within other somewhat differently appearing and somewhat differently constructed dolls through the use of what is considered to be routine mechanical skill in the toy industry.

DETAILED DESCRIPTION

In the drawing there is shown a complete toy 10 in accordance with this invention which utilizes a doll 12 and a support structure 14. This support structure 14 includes a platform 16 which is supported by wheels 18 and 20 of two different sets (not separately numbered). The wheels 18 are connected by an axle 22 and the wheels 20 are connected by a further axle 24. Preferably the wheels 20 are provided with exterior surfaces 26 of rubber or the like which are adapted to develop a high degree of traction against a floor 28.

Figure 5:
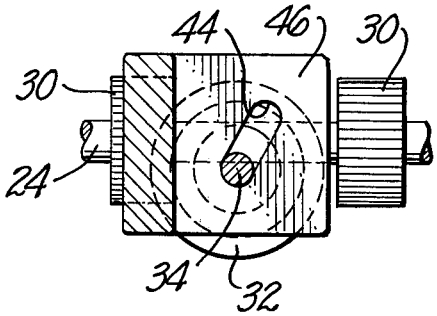
FIG. 5 is a partial cross-sectional view taken at line 5—5 of FIG. 4 indicating the position of a gear and shaft when the wheels on the platform are rotated in one direction.
Figure 6:
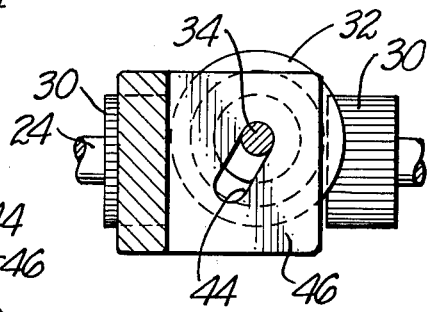
FIG. 6 is a view similar to FIG. 5 indicating an alternate position of this gear and shaft when the wheels on the platform are rotated in the opposite direction.
Figure 6:
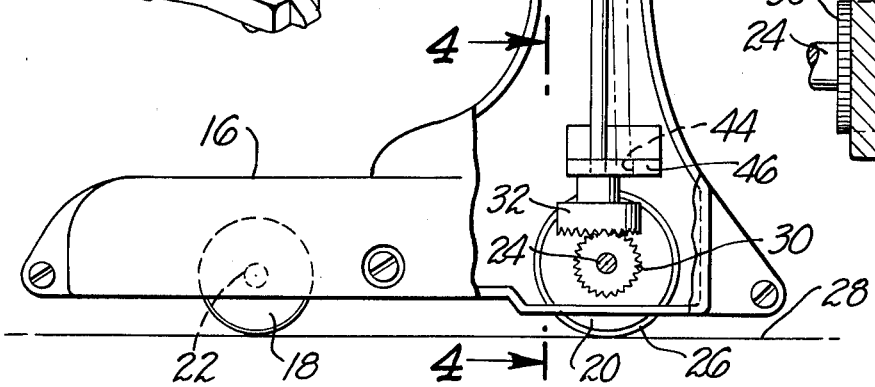
Figures 7, 8, 9, 10, 11:
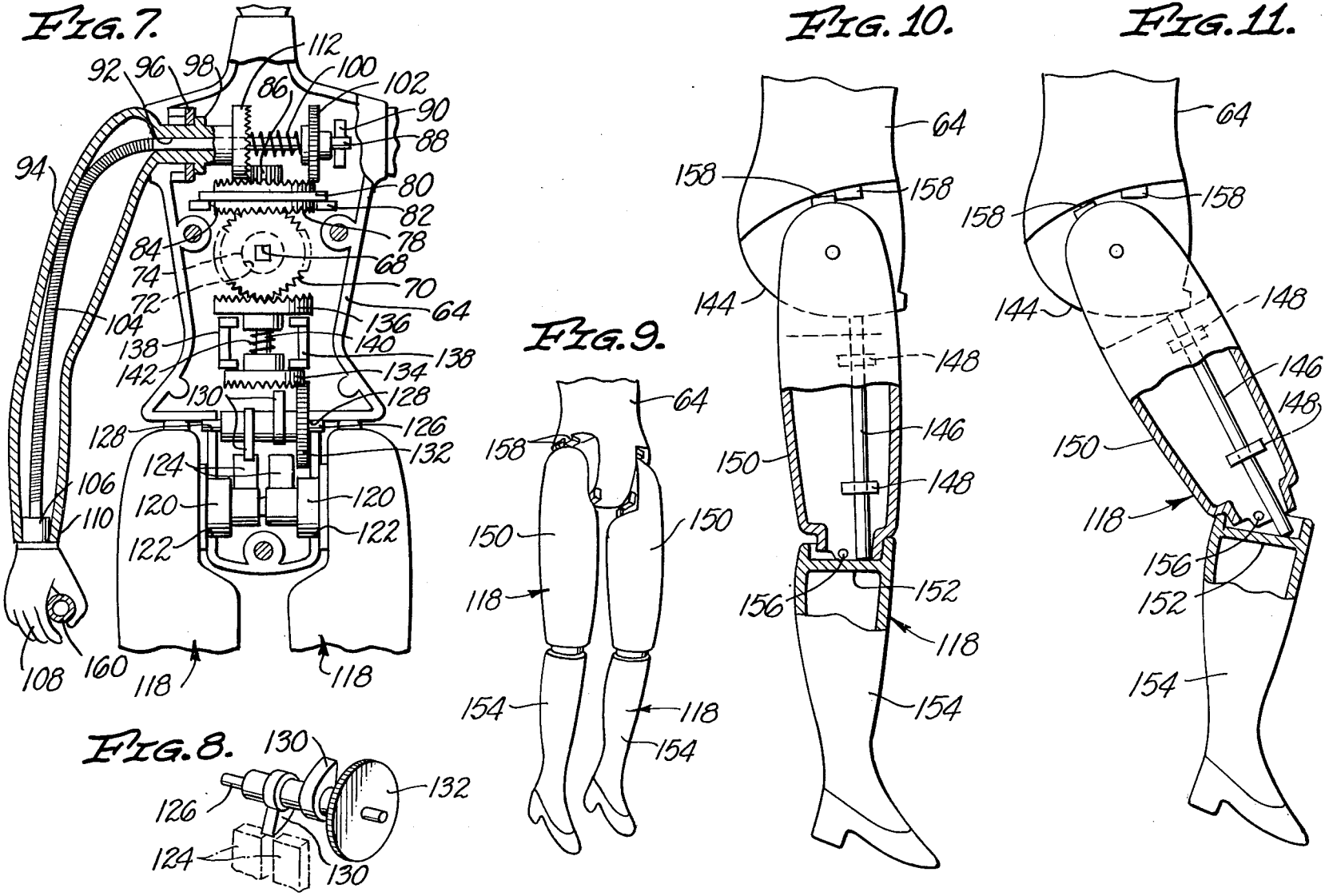
FIG. 7 is a front elevational view partially in section showing the torso of the doll illustrated in the preceding FIGS. 1 and 2 at an enlarged scale and illustrating the connection of the torso to other body parts.
FIG. 8 is an isometric detail view indicating certain parts as are shown in FIG. 7.
FIG. 9 is an isometric view indicating the legs and part of the torso of the doll shown in FIGS. 1 and 2.
FIG. 10 is a partial side-elevational view, partially in section, showing the leg structure and connection of the leg structure illustrated in the preceding figure to the torso of the doll when the leg structure is in one position.
FIG. 11 is a view similar to FIG. 10 showing the leg structure in another position.

The axle 24 connecting the wheels 20 is secured to two different spur gears 30. These gears 30 are spaced from one another and are both constructed so as to be capable of mating with a crown gear 32 in either of two positions of this crown gear 32 as shown in FIGS. 5 and 6. The crown gear 32 is secured to a vertically extending shaft 34 which extends upwardly through a vertically extending hollow support member 36 terminating in a horizontally directed end 38. The shaft 34 is supported within the support member 36 by another crown gear 40 on the shaft 34 resting against a horizontally extending wall 42 serving as a thrust bearing. The shaft 34 is controlled so that the crown gear 32 will mate with either of the gears 30 depending upon the manner in which the toy 10 is operated through the use of a slot 44 in a cross-wall 46 serving as a sliding bearing.

This shaft 34 is sufficiently flexible and is sufficiently loosely supported so that it is capable of sliding within the slot 44 as the platform 16 is rolled along a surface in response to mechanical movement transmitted from the wheels 20 so that the shaft 34 will always rotate in a single direction. In essence, this structure involving contact of the crown gear 32, the gears 30 and the slot 44 extending diagonally with respect to the shaft 34 may be regarded as a type of combined transmission-clutch mechanism of a simplified character for converting any rotation in either direction of the shaft 24 into unidirectional rotation.

The crown gear 40 is used to transmit such unidirectional rotation to a spur gear 48 carried by a small cross-shaft 50 mounted so as to extend through the end 38 and through a non-round extension 52 formed on this end 38. The shaft 50 extends through a perforate wall 54 serving as a bearing and is further supported for rotation by a flange 56 on the shaft 50 fitting closely within the end 38 against a shoulder 58 separating this end 38 from the extension 52. A coil spring 60 is held under compression between the flange 56 and the wall 54 for the purpose of biasing the shaft 50 so that a non-round end 62 on it projects outwardly from the extension 52. This particular structure employed so as to mount the shaft 50 enables the end 62 to be moved generally inwardly toward the support member 36 if there should not be precise alignment of the doll 12 with respect to the shaft 50 as the doll 12 is assembled upon the support structure 14. This tends to prevent physical damage.

The torso 64 of the doll 12 is provided with a non-round socket 66 which is adapted to mate with the extension 52 so as to support the doll 12 on the support structure 14 in such a manner that the doll 12 cannot rotate relative to the support structure 14. The non-round end 62 of the shaft 50 extends through the socket 66 so as to fit within a non-round centrally located opening 68 in a spur gear 70 within the torso 64. This spur gear 70 may be roatably mounted within the torso 64 in any desired manner. In the structure shown it includes an interior cylindrical cavity 72 fitting around a correspondingly shaped exterior 74 of the socket 66. This gear 70 is held in this place by contact with the interior 76 of the torso 64.

The gear 70 is utilized to drive a double ring gear 78 which is provided with a flange 80 resting upon a wall 82 around a circular opening 84. The diameter of this opening 84 closely corresponds to the diameter of the portion of the gear 78 within it so as to secure the gear 78 in position for rotation about an axis. This double ring gear 78 is also provided with an upwardly extending spur gear 86 forming a part of it. The gear 78 is located parallel to a wire 88, a portion of which serves as an axle. This shaft extension 88 is supported within a bearing 90 in the torso 64 and is also supported within an opening in a hollow shaft 92.

This shaft 92 forms a part of and serves as an extension of a simulated arm 94. This shaft 92 is held for rotation on the torso 64 by means of a bearing 96 formed within the torso 64. A small thrust flange 98 on the shaft 92 bears against the bearing 96 for the purpose of preventing movement of the arm 94 away from the torso 64. This shaft 92 is normally biased with the flange 98 in engagement with the bearing 96 by means of a small coil spring 100 held under compression between the shaft 92 and a spur gear 102 secured to the shaft extension 88.

The shaft extension 88 extends from the shaft 92 into the arm 94. Within this arm 94 it is connected to an elongated coil spring 104 serving as a flexible shaft. This spring 104 is in turn secured to a cylindrical extension 106 on a simulated hand 108. A wrist portion 110 of the arm 94 cooperates with the extension 106 so as to serve to rotatably mount the hand 108 relative to the arm 94. It will be apparent from this structure that rotation of the gear 102 will result in rotation of the hand 108. Another crown gear 112 is provided on the shaft 92 in a location where it mates with the spur gear 86. Rotation of this gear 112 will obviously result in rotation of the arm 94 relative to the torso 64. The arm 94 and the hand 108 will rotate at different rates and mutually synchronized because of the construction described and further the hand 108 will rotate relative to the arm 94 as the arm 94 rotates.

The doll 12 also includes another simulated arm 114 which, in the precise toy 10 illustrated, is not intended to move. This doll 12 also includes a head 116 carried by the torso 64 which is not intended to move. The doll 12 also includes two separate legs 118 which are mirror images of one another. Each of the legs 118 includes a cylindrical extenstion 120 extending through a bearing opening 122 into the torso 64. These extensions 120 both carry cam followers 124 which extend from them into the interior of the torso 64. The extensions 120 and the followers 124 are located so that the extensions 120 are generally parallel to a jack shaft 126 mounted upon openings 128 in the torso 64.

This jack shaft 126 carries cams 130 which are adapted to engage and move the followers 124 as a spur gear 132 connected to the cams 130 is rotated. This gear 132 is rotated by contact with a crown gear 134 which is connected to another crown gear 136 which in turn mates with the spur gear 70. These two crown gears 134 and 136 are rotatably mounted upon bearing brackets 138 within the torso 64. They are connected by a shaft 140. If desired this shaft 140 may be a non-round shaft fitting within correspondingly shaped centrally located openings (not shown) so that the gears 134 and 136 can be biased away from one another by a spring 142 in order to hold them in engagement with the gear 70 and with the gear 132, respectively.

With this structure the cams 130 are spaced from one another so as to engage the followers 125 at equally spaced intervals in order to cause the legs 118 to be pivoted in a manner corresponding to walking. As such a pivoting action occurs curved surfaces 144 serving as cams located upon the torso 64 will be brought into contact with actuating rods 146 mounted for linear movement by bearings 148 in the thigh portion 150 of the legs 118. As this occurs these rods 146 will bear against cross-walls 152 in simulated lower leg portions 154 to cause these portions 154 to pivot about pins 156 pivotally connecting the thigh portions 150 and lower leg portions 154.

With this action as the described mechanism within the doll 12 is actuated each leg 118 will be alternately lifted in the manner in which first one leg and then another leg of a human is lifted in walking. After the lifting action of a cam 130 has passed the corresponding leg 118 will be released so as to fall back to a substantially normal vertical position through the action of gravity. As this occurs the rods 146 will be pushed back to their initial position. Stops 158 on the legs 118 and on the torso 64 will prevent the action of gravity from moving the legs 118 backward to an extent corresponding to the limit that the human legs may be moved backward.

It will be realized from the aforegoing that when the toy 10 is assembled as described and when the support structure 14 is pushed upon a floor 28 that the doll 12 will appear to be marching in a forward manner while the arm 94 of the doll 12 twirls around in much the manner in which the arm of a drum major or majorette rotates while holding a baton. The toy 10 also includes a baton 160 frictionally engaged with the hand 108 so as to accurately simulate the action of a drum major or majorette in a parade. This action is considered to be quite effective and desirable for play purposes.

I claim:

1. The combination of a doll having a torso, arms, legs and a head connected together so as to simulate the human body and a support structure for holding the doll in which the improvement comprises:

said support structure including a wheeled platform, a support member extending from the platform to the torso and mechanical drive means for deriving power from at least one wheel of said platform as said platform is rolled along a surface and for conveying motion derived from such movement of said platform into the interior of said torso of said doll, an arm of said doll being rotatably mounted upon said torso and motion transmitting means within said torso for transmitting motion from said mechanical drive means to said arm so as to rotate said arm as said platform is rolled along said surface.

2. The combination claimed in claim 1 wherein:

said doll is held by said support member so as to be above said surface as said platform is rolled along said surface, both of said legs are pivotally mounted upon said torso so as to be capable of being moved relative to said torso, and including cam means operatively connected to said motion transmitting means for alternately raising said legs as said platform is rolled along said surface in order or simulate normal leg movement.

3. The combination claimed in claim 2 wherein:

each of said legs includes a thigh portion rotatably mounted on said torso and a lower leg portion rotatably mounted on a thigh portion, and including further cam means for causing each of said lower leg portions to rotate relative to one of said thigh portions during the operation of said first mentioned cam means to move said leg portions.

4. The combination claimed in claim 3 wherein:

said further cam means includes cam surfaces located on said torso and rods movably mounted on said thigh portions, said rods bearing against said cam surfaces on said torso and against said lower leg portions so as to transmit motion between said cam surfaces and said lower leg portions.

5. The combination claimed in claim 1 including:

a baton mounted on the extremity of said arm remote from said torso.

6. The combination claimed in claim 5 wherein:

said arm includes a hand mounted on said arm, said baton is held by said hand so as to rotate therewith, said motion transmitting means includes means for separately rotating said hand relative to said arm and for rotating said arm relative to said torso so that said hand rotates relative to said arm as said arm rotates relative to said torso.

7. The combination claimed in claim 1 wherein:

said mechanical drive means includes transmission-clutch means for always conveying motion in the same direction to said doll regardless of the direction that said wheeled platform is rolled along said surface.

8. The combination claimed in claim 1 wherein:

said doll is held by said support member so as to be above said surface as said platform is rolled along said surface, both of said legs are pivotally mounted upon said torso so as to be capable of being moved relative to said torso, each of said legs includes a thigh portion rotatable mounted on said torso and a lower leg portion rotatably mounted on a thigh portion, said further cam means includes cam surfaces located on said torso and rods movably mounted on said thigh portions, said rods bearing against said cam surfaces on said torso and against said lower leg portions so as to transmit motion between said cam surfaces and said lower leg portions, said arm includes a hand mounted on said arm, said baton is held by said hand so as to rotate therewith, said motion transmitting means includes means for separately rotating said hand relative to said arm and for rotating said arm relative to said torso so that said hand rotates relative to said arm as said arm rotates relative to said torso, said mechanical drive means includes transmission-clutch means for always conveying motion in the same direction to said doll regardless of the direction that said wheeled platform is rolled along said surface, and including cam means operatively connected to said motion transmitting means for alternately raising said legs as said platform is rolled along said surface in order to simulate normal leg movement, further cam means for causing each of said lower leg portions to rotate relative to one of said thigh portions during the operation of said first mentioned cam means to move said leg portions, a baton mounted on the extremity of said arm remote from said torso.

* * * * *